United States Patent [19]

Sato

[11] Patent Number: 4,645,558

[45] Date of Patent: Feb. 24, 1987

[54] FILM FEEDING APPARATUS

[75] Inventor: Minoru Sato, Funabashi, Japan

[73] Assignee: Tokyo Automatic Machinery Works, Ltd., Tokyo, Japan

[21] Appl. No.: 639,488

[22] Filed: Aug. 10, 1984

[30] Foreign Application Priority Data

Nov. 10, 1983 [JP] Japan ..... 58-174546[U]

[51] Int. Cl.[4] ..... B65H 19/18; B65H 69/06

[52] U.S. Cl. ..... 156/351; 156/353; 156/361; 156/366; 156/378; 156/504; 156/505; 242/56 R; 242/58.1; 242/58.5

[58] Field of Search ..... 156/504, 505, 351, 353, 156/361, 366, 378, 157, 159; 242/58.1, 58.5, 56 R

[56] References Cited

U.S. PATENT DOCUMENTS

| | | | |
|---|---|---|---|
| 4,108,391 | 8/1978 | Martinez | 156/505 |
| 4,116,399 | 9/1978 | Mosburger et al. | 156/504 |
| 4,155,516 | 5/1979 | Hughes et al. | 242/58.1 |
| 4,157,934 | 6/1979 | Ryan et al. | 156/505 |
| 4,390,388 | 6/1983 | Nagata et al. | 156/504 |
| 4,481,053 | 11/1984 | Tokuno et al. | 156/505 |

*Primary Examiner*—Michael Wityshyn

*Attorney, Agent, or Firm*—Watson, Cole, Grindle & Watson

[57] ABSTRACT

A novel apparatus is provided for feeding a packaging film with registered marks to a working machine, such as a packaging machine which packs products in wraps. According to the apparatus, rapid and continuous feeding of the film is realized. Further, one operator can watch and control a plurality of machines.

7 Claims, 6 Drawing Figures

FILM FEEDING APPARATUS

BACKGROUND OF THE INVENTION

1. Field of the Invention

This invention relates to an apparatus for feeding a packaging film with registered marks to a working machine, such as a packaging machine which packs products in wraps.

2. Description of the Prior Art

In a conventional film feeding apparatus having a main roll for feeding a first film to a packaging machine, when the first film on the main roll is consumed, the main roll must be exchanged for auxiliary roll and the latter must be reset. However, the exchange of the main roll for the auxiliary roll and the reset of the auxiliary roll are troublesome operations. In a known film feeding apparatus having a main roll of a first film and an auxiliary roll of a second film, the front end of the second film is manually connected to the terminal end of the first film. However, in connecting the first film to the second film, registered marks or patterns on the first and second films must be carefully registered with each other. Such registration operation is rather troublesome.

Furthermore, in the prior art as mentioned above, when the first film is exchanged for the second film, or when the second film is connected to the first film, the film feeding machine must be stopped, resulting in a decrease of a working efficiency of the packaging machine to which the film is fed, and in a decrease of a productivity. In addition to the foregoing, an operator must continuously watch the end of the first film and the charging of the second film in the feeding machine exclusively needs at least one operator.

SUMMARY OF THE INVENTION

The primary object of the present invention is, therefore, to eliminate the above mentioned drawbacks of the prior art, by providing a film feeding apparatus in which the film can be rapidly charged so as to continuously feed the film, thereby to increase the working efficiency and the productivity of the machine to which the film is to be fed, and to enable only one operator to control a plurality of film feeding apparatuses.

In order to achieve the aforementioned object, according to the present invention, there is provided a film feeding apparatus comprising a body which has a first film roll for feeding a first film with positioning registered marks and an auxiliary film roll for feeding a second film with positioning registered marks, for feeding the first film to a working machine such as a packaging machine, through a conveying path, wherein said apparatus comprises a first sensor on the conveying path for detecting the end of the first film and a second sensor on the conveying path for detecting the positioning registered marks of the first film that are located adjacent to the terminal end of the first film, a film holder for holding the beginning end of the second film, a film pressing member for pressing the first film against the second film, said film holder and said film pressing member being located on opposite sides of the conveying path so that the film pressing member comes away from and close to the film holder, the first positioning registered marks of the second film being spaced from the beginning end thereof at a predetermined distance, said beginning end of the second film being provided with an adhesive tape which is partially adhered thereto, a cutter located in the vicinity of the film holder for cutting the first film in order to separate the first film from the first film roll, and means for actuating said film holder and/or said film pressing member to cause them to come close to each other in order to connect the first film to the second film by means of the adhesive tape at the beginning end of the second film and for actuating the cutter to cut the first film, when the first sensor detects the end of the first film and then the second sensor detects the first positioning registered marks.

BRIEF DESCRIPTION OF THE DRAWINGS

The invention will be described below in detail with reference to the accompanying drawings, in which.

DESCRIPTION OF THE PREFERRED EMBODIMENT

Figure 5:
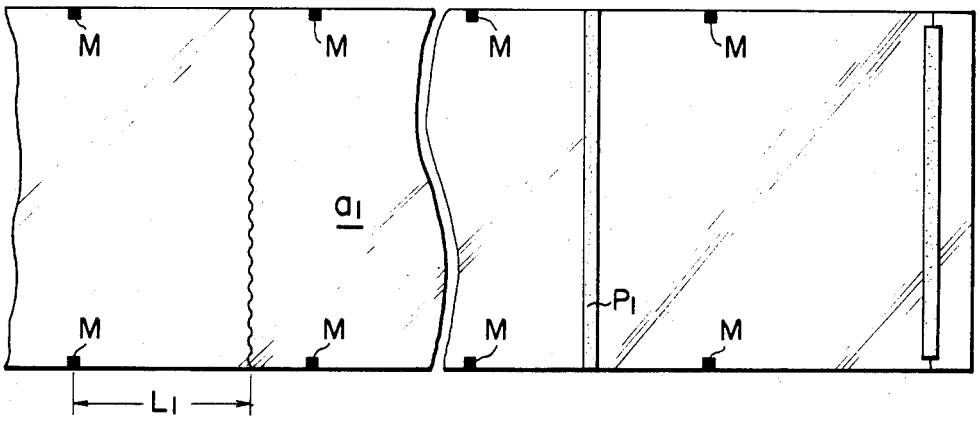
FIG. 5 is a plan view of a terminal end of a first film.

In the drawings, a body 1 of the film feeding apparatus of the present invention is provided, on its side plates l*a*, with roll supports 2 which rotatably support a main roll A1 which feeds a first film $a_1$ and an auxiliary roll A2 which feeds a second, i.e. auxiliary film $a_2$. On a rear surface 1*b* and a upper surface 1*c*, of the body 1 are provided rotatable guide rollers 11, 12, 13, 14, and 15 which form a conveying path of the first film $a_1$. A first sensor S1, a film holder 3, and a cutter 4 are provided between the guide rollers 11 and 12. The first sensor S1 can be a light reflection type optical sensor which has light emitting and receiving elements (not shown) located on the opposite sides of the conveying path between the guide rollers 11 and 12. The first film $a_1$ has an aluminum foil P1 applied to a terminal end thereof for indicating the end of the first film, as shown in FIG. 5, so that the first sensor S1 can detect the aluminum foil P1 to detect the end of the first film $a_1$.

Figure 3:
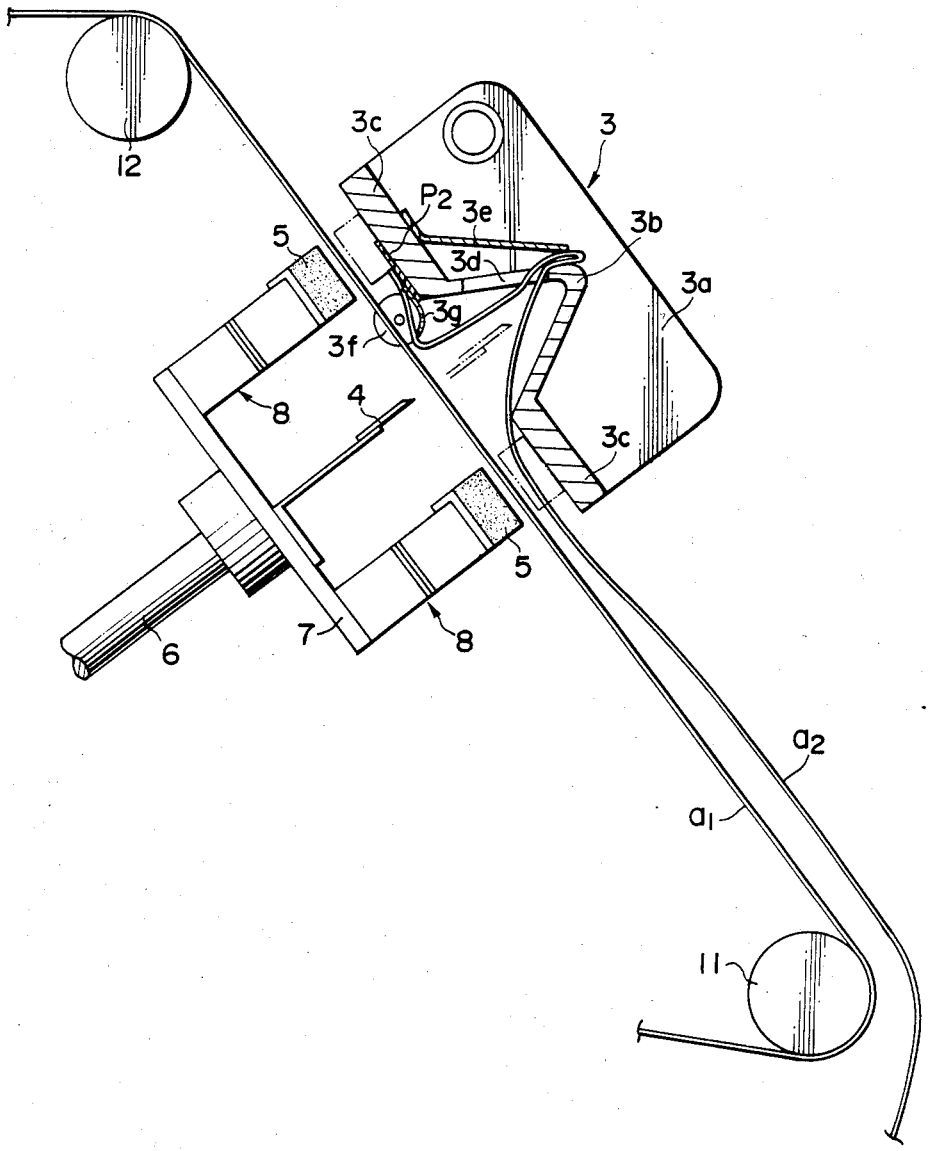
FIG. 3 is an enlarged view of a part of FIG. 2.

The holder 3 has side plates 3*a* and pressing plates 3*c* which are located between the side plates 3*a* and which has an intermediate V-shaped channel 3*b* which, in turn, has an elongated hole 3*d* having a length corresponding to the film width, and a leaf spring 3*e* for engaging the film, as can be seen from FIG. 3. The side plates 3*a* have mounting members 3*f* which hold a holding plate 3*g* therebetween.

Figure 4:
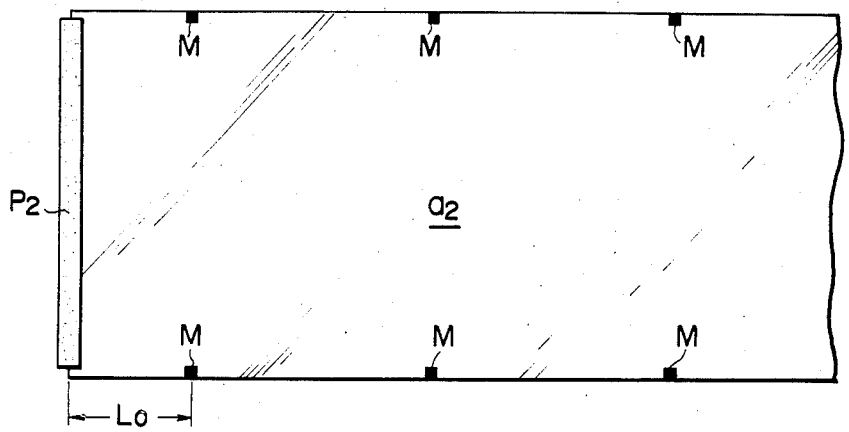
FIG. 4 is a plan view of a front end of a second film.

The second film $a_2$ is cut at a terminal end spaced at a predetermined distance Lo from the leftmost (in FIG. 4) registered marks M which are provided in advance on the second film, as shown in FIG. 4. An adhesive tape P2 is applied to the cut terminal end of the second film, so that the adhesive tape P2 is adhered, at its one side end, to the holding plate 3*g*, and at its intermediate portion, to the front end of the second film $a_2$. The opposite side end of the adhesive tape P2 is located on one of the pressing plates 3*c*. The adhesive surface of the adhesive tape P2 is spaced from and opposed to the first film $a_1$.

Rubber pressing plates 5 are mounted to leaf springs 8 which are mounted to a mounting member 7 secured to a piston rod of a pneumatic cylinder 6 and are opposed to the corresponding pressing plates 3*c* in such a way that the first film $a_1$ extends between the corresponding rubber pressing plates 5 and the pressing plates 3*c*. Each of the leaf springs 8 is made of two leaves which are bent and interconnected into an elliptical shape, so that when the rubber pressing plates 5 are pressed against the corresponding pressing plates 3*c* through the first film $a_1$ by means of the operation of the pneumatic cylinder 6, the elliptical leaf springs 8 are deformed into a collapsed ellipse having a shorter minor axis and a longer major axis. When the elliptical leaf springs 8 are collapsed or deformed, the cutter 4 rigidly connected to the center portion of the mounting member 7 thrusts into the first film $a_1$ and cut the same. The V-shaped channel 3*b* enables the cutter 4 to come therein.

Figure 1:
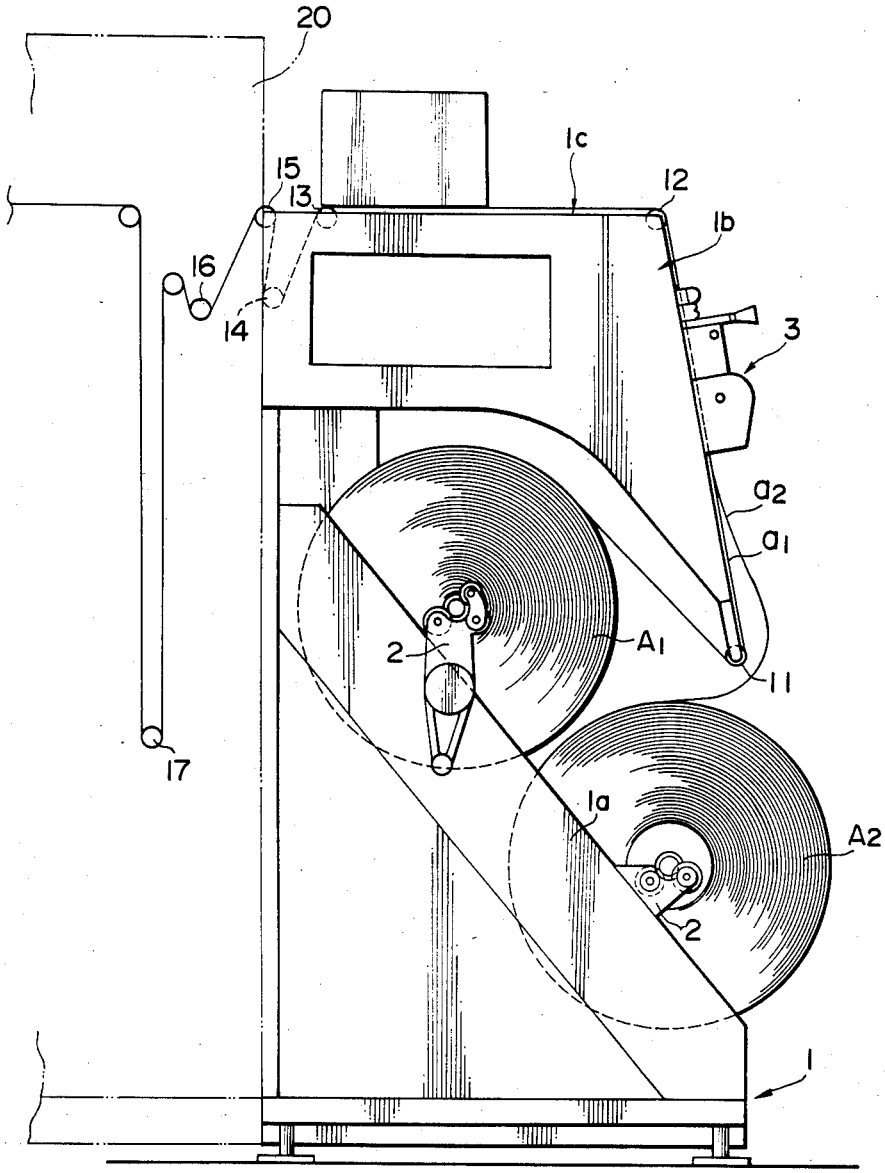
FIG. 1 is a side elevational view of a film feeding apparatus according to the present invention.
Figure 2:
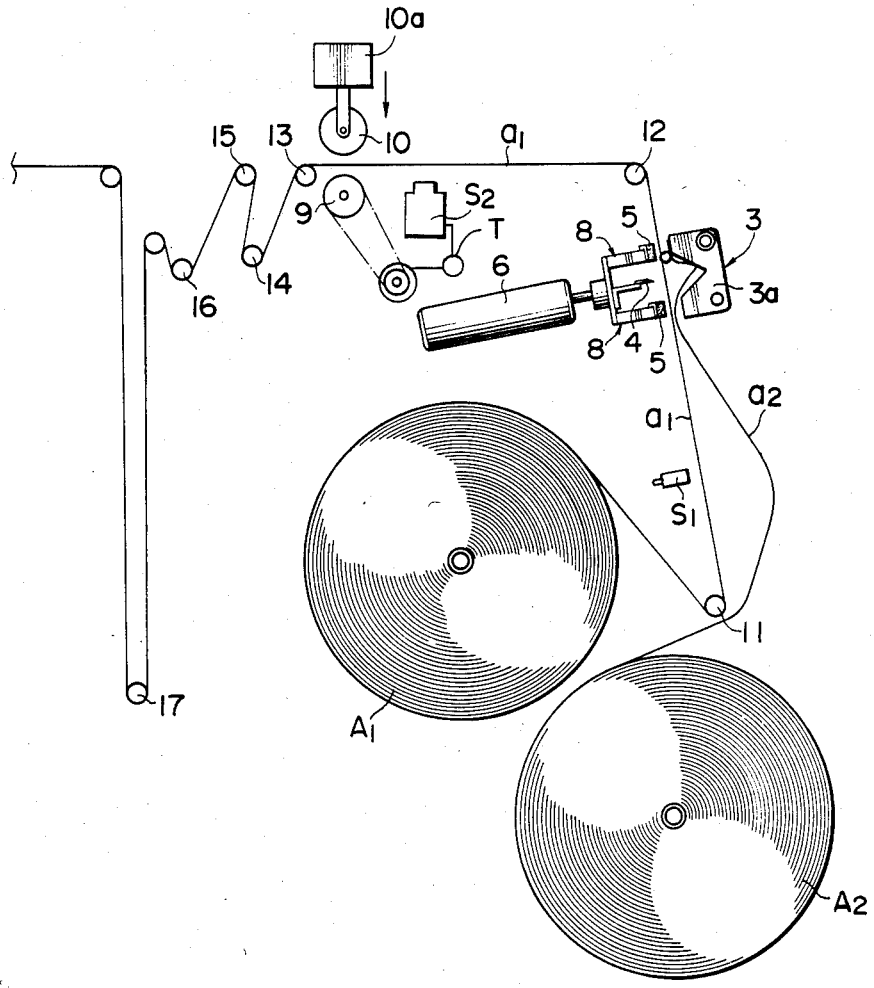
FIG. 2 is a schematic view showing the operation of the apparatus according to the present invention.

A second sensor S2, a drive roller 9 and a pressing roller 10 are arranged between the guide rollers 12 and 13 on the upper surface 1*c* of the body 1. The drive roller 9 is connected to and driven by a motor with an electromagnetic brake (not shown) so as to rotate at a constant speed. The pressing roller 10 is opposed to the drive roller 9, so that the first film $a_1$ extends therebetween. The pressing roller 10 is connected to and actuated by a pneumatic cylinder 10*a* so as to move up and down. The pressing roller 10 moves downward in accordance with a detection signal of the first sensor S1 which detects the completion of the first film $a_1$ to feed the first film at a constant speed, with the help of the drive roller 9 which holds the first film between the drive roller 9 and the pressing roller 10. When the second sensor S2 detects the first registered marks M of the first film which now moves at a constant speed, a timer T (FIG. 2) which is connected to the second sensor S2 is made on. After preset time of the timer T lapses, the cutter 4 cuts the first film $a_1$. The set time of the timer T can be properly selected in accordance with a distance L1 (FIG. 5) between the portion of the first film that is to be cut and the registered marks M, so as to prevent the connecting portion, i.e., the seam of the first film to the second film from coming into registration with a lateral seal portion which will be made later. The pressing roller 10 moves upward as soon as the first film $a_1$ is cut by the cutter 4.

Figure 6:
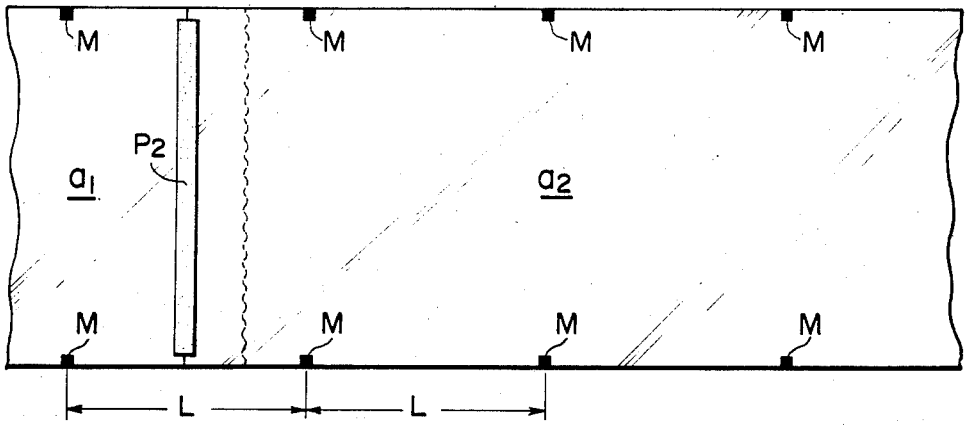
FIG. 6 is a plan view of a connecting portion of the first film and the second film.

The distance Lo between the front end and the first registered marks M, of the second film $a_2$ is such that when the second film $a_2$ is adhered to the first film $a_1$, the distance L between the last registered marks M of the first film $a_1$ and the first registered marks M of the second film $a_2$ is identical to that of two adjacent registered marks of the first or second film, as shown in FIG. 6. The connection of the first and second films is effected when the second sensor S2 detects the first registered marks M subsequent to the detection of the end of the first film $a_1$. In the illustrated embodiment, the working machine 20 is supposed to be a packaging machine for packing products into wraps which are formed by the film with registered marks. In such an embodiment, it is possible to provide tension rollers 16 and 17 for controlling the tension of the film. Alternatively, it is also possible to provide the tension rollers 16, 17 on the film feeding apparatus of the present invention rather than on the working machine 20.

The apparatus according to the present invention operates as follows.

First, the front end of the second film $a_2$ is formed as shown in FIG. 4 and is held by the holder 3.

When the first sensor S1 detects the aluminum foil P1 of the first film $a_1$ at the end of the first film $a_1$, the pressing roller 10 moves downward to feed the first film at a constant speed. After the feed of the first film at a constant speed starts, the second sensor S2 detects the first registered marks M to actuate the cylinder 6, so that the rubber pressing plates 5 cause the first film $a_1$ to come into press contact with the pressing plates 3*c* with the help of the leaf springs 8. By the press contact of the first film against the pressing plates 3*c*, the first film is adhered to the adhesive tape P2 of the second film $a_2$ through the upper rubber pressing plate 5 that is opposed to the front end of the second film $a_2$. The first film $a_1$ can be thus automatically connected to the second film $a_2$.

After a predetermined time lapses, the pneumatic cylinder 6 is further advanced to cut the first film, and is then returned to its initial position shown in FIG. 3. As a result of this, the second film $a_2$ is continuously fed following the rear end of the first film $a_1$, so that the feed of the auxiliary film, i.e. the second film can automatically be effected. After that, the first roll A1 is removed and-then the second roll A2 is moved to a first position where the first film was located and has been removed from. A new auxiliary film is put in a second position for the second roll which has been moved to the first position for the first roll A1. The front end of the auxiliary film, i.e. a new second film $a_2$ is held by the holder 3, as shown in FIG. 3.

As can be understood from the above discussion, according to the present invention, the auxiliary film can be automatically fed after the first film ends without stopping the operation of the machine, thus resulting in rapid and continuous feeding of the film. Furthermore, according to the present invention, one operator can watch and control a plurality of machines.

What is claimed is:

1. A film feeding apparatus comprising a body which has a first film roll for feeding a first film with positioning registered marks and an auxiliary film roll for feeding a second film with positioning registered marks, and means for feeding the first film to a working machine through a conveying path, wherein said apparatus comprises a first sensor on the conveying path for detecting the end of the first film and a second sensor on the conveying path for detecting the positioning registered marks on the first film that are located adjacent to the terminal end of the first film, a film holder for holding the beginning end of the second film, said film holder comprising a pair of side plates which has therebetween a pressing plate with an intermediate V-shaped recess, said pressing plate being provided, in the V-shaped recess, with an elongated hole having a length corresponding to the width of the first and second films, said pressing plate having an elastic engaging means for holding the second film, a film pressing member comprising a rubber plate actuated by a pneumatic cylinder for pressing the first film against the second film, said film pressing member further including a leaf spring which elastically connects the rubber plate to the pneumatic cylinder and which is made of two bent leaves interconnected in the form of an ellipse, so that the leaf spring can be elastically deformed when the rubber plate comes into press contact with the film holder by the operation of the pneumatic cylinder, said film holder and said film pressing member being located on opposite sides of the conveying path so that the film pressing member comes away from and close to the film holder, the first positioning registered marks of the second film being spaced from the beginning end thereof at a predetermined distance, said beginning end of the second film being provided with an adhesive tape which is partially adhered thereto, a cutter located in the vicinity of the film holder for cutting the first film in order to separate the first film from the first film roll, said pneumatic cylinder capable of actuating said film holder and/or said film pressing member to cause them to come close to each other in order to connect the first film to the second film by means of the adhesive tape at the beginning end of the second film and actuating the cutter to cut the first film by thrusting the cutter into the first film and entering the V-shaped recess of the film holder, wherein the first sensor detects the end of the first film and then the second sensor detects the first positioning registered marks, and timer means for controlling the time at which the cutter begins operating subsequent to the detection of the first positioning registered marks by the second sensor.

2. An apparatus according to claim 1, wherein said first sensor is a light reflection type optical sensor, and wherein said first film has an aluminum foil applied thereto in the vicinity of the terminal end, so that said first sensor can detect the aluminum foil to detect the end of the first film.

3. An apparatus according to claim 1, wherein said adhesive tape is adhered to the pressing plate of the film holder at one end of the adhesive tape, and to the beginning end of the second film at the intermediate portion of the adhesive tape, and has an opposite end to said one end, to which the first film is to be adhered.

4. An apparatus according to claim 1, wherein said conveying path of the first film comprises a plurality of guide rollers which are rotatably supported on the body of the apparatus.

5. An apparatus according to claim 4, wherein said first sensor is a light reflection type optical sensor, and wherein said first film has an aluminum foil applied thereto in the vicinity of the terminal end, so that said first sensor can detect the aluminum foil to detect the end of the first film.

6. An apparatus according to claim 4, further comprising means for feeding the first film at a constant speed along the conveying path when said first sensor detects the end of the first film, wherein the feeding of the first film at constant speed ends when the first film is cut by said cutter.

7. An apparatus according to claim 6, wherein said means for feeding the first film at a constant speed comprises a drive roller for driving the first film and a pressing roller which is located on the opposite side of the conveying path to the drive roller so as to hold the first film between the drive roller and the pressing roller in order to feed the first film at a constant speed.

* * * * *